United States Patent [19]

Paoluccio

[11] Patent Number: 4,616,557

[45] Date of Patent: Oct. 14, 1986

[54] AIR MIXING DEVICE AND METHOD FOR PREVENTING INSECTS FROM FINDING HUMAN BEINGS

[76] Inventor: John A. Paoluccio, 3530 Kiernan Ave., Modesto, Calif. 95356

[21] Appl. No.: 753,725

[22] Filed: Jul. 10, 1985

Related U.S. Application Data

[63] Continuation-in-part of Ser. No. 604,904, Apr. 27, 1984, abandoned.

[51] Int. Cl.[4] ..... F24F 7/007

[52] U.S. Cl. ..... 98/31.5; 62/414

[58] Field of Search ..... 98/38.1, 31.5, 40.01, 98/40.21, 40.23

[56] References Cited

U.S. PATENT DOCUMENTS 2,258,731 10/1941 Blumenthal ..... 98/40 B
2,547,448 4/1951 Demuth ..... 98/38
3,463,391 8/1969 Haegens ..... 98/38 F

FOREIGN PATENT DOCUMENTS 503594 4/1939 United Kingdom ..... 98/40.21

*Primary Examiner*—Harold Joyce
*Attorney, Agent, or Firm*—Robert S. Smith

[57] ABSTRACT

Apparatus for mixing air within a room includes a hollow leg section having, at one axial location, a circumferentially extending outlet section. The leg section is disposed in substantially perpendicular relationship to the circumferentially extending outlet section. The apparatus also includes a fan disposed in spaced relation from the lowest extremity of the leg section and oriented to push a gas into the leg section and out the circumferentially extending outlet section. The fan is dimensioned to draw primary air through the fan, the primary air drawing secondary ambient air. A sleeve shaped first member is disposed in spaced relationship to the hollow leg section and in spaced relationship from the circumferentially extending outlet section.

5 Claims, 3 Drawing Figures

AIR MIXING DEVICE AND METHOD FOR PREVENTING INSECTS FROM FINDING HUMAN BEINGS

This application is a continuation-in-part application of application Ser. No. 604,904, filed on Apr. 27, 1984 now abandoned.

BACKGROUND OF THE INVENTION

The invention relates to air mixing devices for use on air conditioning systems, refrigerator systems, and the like. Large fans suspended from the ceiling and rotating in a horizontal plane are increasingly being used to circulate both warm and cool air. While such fans are effective, they are not satisfactory for many room air conditioner applications. Hoffman U.S. Pat. No. 2,583,374 shows an abstract fan which directs air flow at a divider which forces the air back around a fan blade where it is caused to induce additional air flow. Such apparatus is not concerned with mixing air within a room, but, with directing air outside a building.

Presently, existing systems usually utilize primary air handling units or fans where conditioned air enters the space at various supply points. The supply air then mixes the room air. The fan static pressure of the supply fan is usually high to overcome the pressure drop of air conditioning components, such as louvers, filters, ductwork, coils, heat exchangers and air outlets. Since the primary air is sized mainly to handle the heating and cooling needs and to overcome the above described pressure drops, a relatively low amount of air is actually put into motion.

The current methods of air distribution for refrigeration in agricultural and food processing applications result in poor temperature and environmental control. The humidity, air temperature and air motion are uneven and, thus, the results are unsatisfactory. The poor environment in processing food products can cause waste, reduced quality and increased costs as well as health and sanitation problems. The present use of propeller fans to aid in mixing the air helps but fails to provide uniform air distribution. High velocity jet streams still persist. In essence, air conditioning systems for human environments are being used in food processing application with poor results.

Existing systems rely on extensive ductwork and fans to help with air mixing and distribution. In many instances, they are acceptable for human comfort. However, these systems all fail to provide thorough air mixing throughout the room without imposing high air velocity jet streams. These jet streams cause numerous drying problems in the meat processing industry where drying is of the utmost importance. The air film thickness surrounding the product varies greatly with all existing systems. The vapor pressure differential is controlled by air film thickness from velocity, temperature and humidity. The food products are usually stacked close together, and existing systems result in non-uniform drying. Case hardening, spoilage, waste, poor quality, long drying time and high production costs are common.

The advantage of the present invention is that it converts all the fan energy to inducing the mixing of air by aspiration from low air pressure areas created by high velocity. The present invention may be used with almost any existing environmental system to radically improve the quality of the environmental control. This is achieved mainly by providing more uniform velocity and eliminating large temperature differentials (hot and cold spots and drafts), providing uniform humidity thereby causing the temperature control system to function more precisely. In the agricultural and food processing industries, the invention can provide the high quality environment needed to produce uniform finished products.

One particularly advantageous application of the present invention is in the area of meat processing, such as the processing of salami and pepperoni. These products are stored in large drying or aging rooms for 15 to 30 days to properly cure. They are dried slowly by a combination of factors including air velocity, temperature and humidity, product composition, weight, diameter, etc. The most critical factor is the air velocity that flows over the product. This regulates the air film thickness surrounding the product and maintains the moisture vapor pressure differential between the product and the room air. The accurate control of this air film thickness can be provided with this invention. The overall air motion in the room is increased many times over all conventional methods with no increase in energy and without high velocity air jet streams. Air motion is provided around all products and is uniform through the room. All products are cured at the same rate, resulting in high quality products. The speed of drying is also increased, thereby reducing processing costs. This is done by reducing the air film thickness on the surface of the product uniformly throughout the room.

An existing environmental system, which would otherwise have to be replaced to provide satisfactory operation, often will be satisfactory when used with the air inducing device in accordance with the invention. The modifications to conventional systems are generally inexpensive and minor, since the air inducing device of the present invention may be easily added. It is difficult to oversize or undersize any such devices. The larger the air mixing system added, the better the entire system works (within reasonable limits).

In addition to the relatively low cost of modifying the existing air conditioning system, many other benefits are realized. Drying time for processed meats is reduced, mold and mildew are eliminated on interior space surfaces, production time is speeded up, product quality is improved, waste is eliminated, and less energy is consumed. All these are benefits to the consumer. Another benefit is that a small fan can effectively put in motion many times its primary air output due to the configuration of the device. Not only will a great quantity of air be put into motion, but all high velocity air streams will be substantially reduced.

This invention is the only high air volume, low velocity, low energy use air mixing device that does not use ductwork.

It works on the laws of "conservation of momentum" wherein the high velocity mass of primary air from the fan is redirected at the air induction blades. Room air is induced into this high velocity air. The result is a great mass of mixed air set in motion at low velocity.

The blades of the device could be made adjustable to obtain the ideal mixing rate for rooms of differing size, shape and height.

An object of this invention is to provide a simple, inexpensive, effective means of supplying uniform temperature, humidity and air movement within a given space. This air inducing device thoroughly mixes all the air in the room, creating a homogeneous mixture without any high velocity air streams. This device will be especially useful in the agricultural and food processing industries. Use of this device will result in uniform processing of food products, thereby minimizing food product waste, lowering product cost and improving its quality.

A further object of this invention is to correct the numerous environmental problems that currently exist both for industry and food processors.

SUMMARY OF THE INVENTION

The foregoing objects and other objects and advantages which shall become apparent from the detailed description of the preferred embodiment are attained in an apparatus for mixing air within a room which includes a hollow leg section having, at one axial location, a circumferentially extending outlet section. The leg section is disposed in substantially perpendicular relationship to the circumferentially extending outlet section. The apparatus also includes a fan disposed in spaced relation from the lowest extremity of the leg section and oriented to push a gas into the leg section and out the circumferentially extending outlet section. The fan is dimensioned to draw primary air through the fan, the primary air drawing secondary ambient air. A sleeve shaped first member is disposed in spaced relationship to the hollow leg section and in spaced relationship from the circumferentially extending outlet section.

The sleeve shaped first member may be coaxial with the hollow leg section. The sleeve shaped first member may be coaxial with the circumferentially extending outlet section. The apparatus may further include a splitter member disposed in the hollow leg section substantially at the circumferentially extending outlet section. The apparatus may be rotationally symmetrical.

A method of preventing insects from locating human beings which includes mixing ambient air to eliminate convective heat currents, differences in vapor pressure, and uniformly distribute natural body particles, odors and gases to such a high degree that a homogeneous mixture occurs, thus resulting in an environment that prevents insects from locating human beings in the ambient.

BRIEF DESCRIPTION OF THE ACCOMPANYING DRAWINGS

The invention will be better understood by reference to the accompanying drawing in which.

DESCRIPTION OF THE PREFERRED EMBODIMENT

Figure 1:
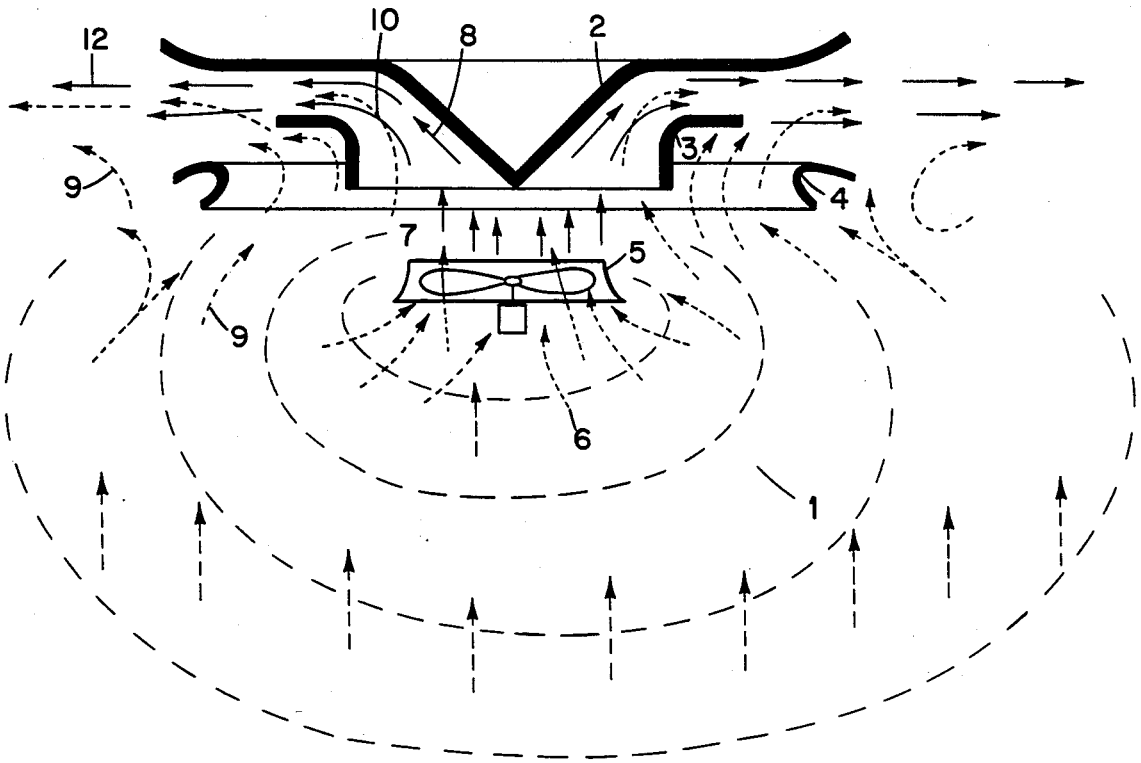
FIG. 1 is a schematic view of the apparatus in accordance with one form of the invention.
Figure 2:
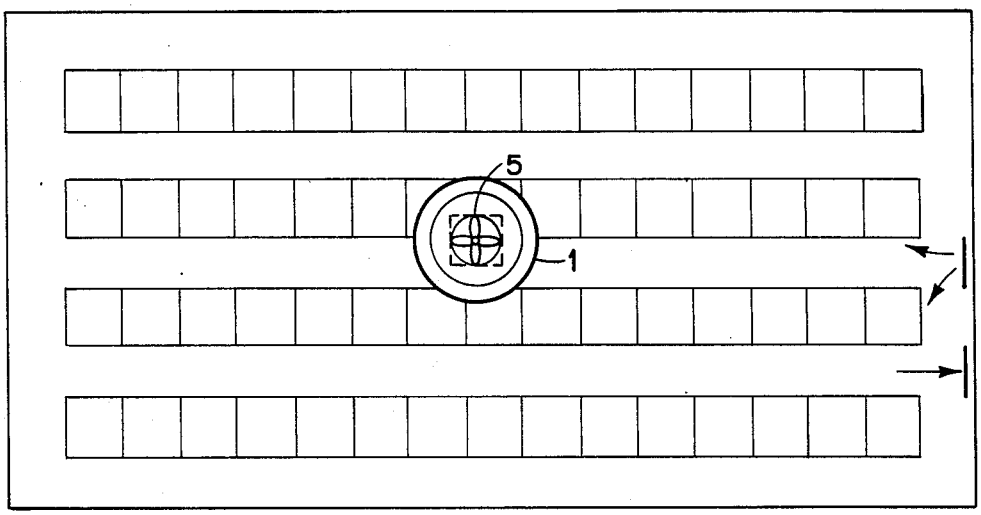
FIG. 2 is a plan view of a view of a room equipped with the present invention.
Figure 3:
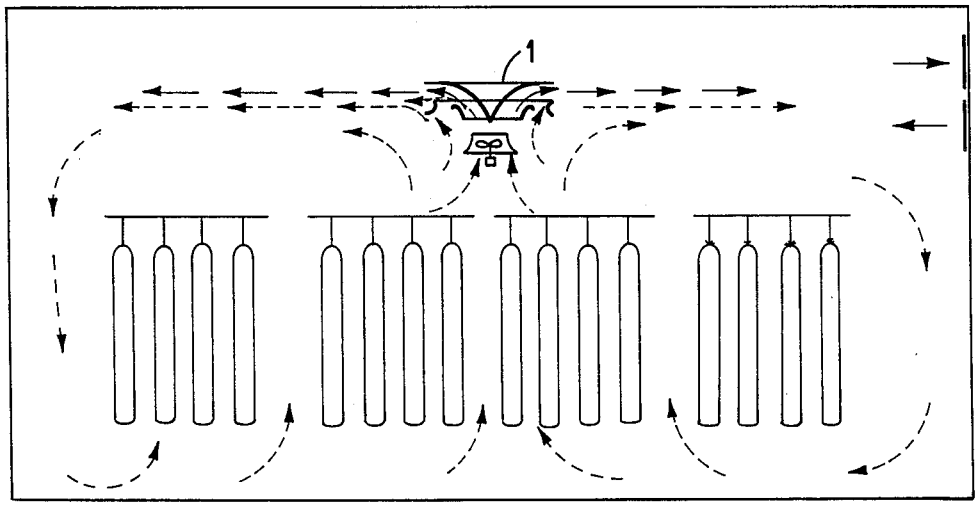
FIG. 3 is a sectional view taken along a vertical plane in a food processing room.

Referring now to FIGS. 1, 2, and 3, there is shown an air mixing device 1 which includes a fan 5. The fan 5 and the remainder of the air mixing device 1 are disposed in generally coaxial relationship. As room air 6 passes through the fan 5, its velocity is increased as a result of the fan 5 speed and configuration. Discharge air 7 leaves the fan 5 at high velocity. The high velocity discharge air 7 approaches a splitter 2 where its path 8 is redirected from vertical to horizontal by the shape of the air deflector or splitter 2 of the air mixing device 1. A curved blade 3 of the air mixing device 1 is shaped to induce air 9 into the primary air 7 stream or flow from the low pressure region created by the high air velocity. The resulting mixed air 10 passes between and leaves the space between the deflector or splitter 2 and the curved blade 3. This further induces more of the air 9 from the new low pressure area created. This mixed air 11 passes between the deflector or splitter 2 and another curved blade 4, and again more air 9 is induced into the air stream 11 to produce a combined mixed air stream 12 which has a relatively large quantity of mixed air at relatively low velocity. Thorough air mixing thus results throughout the conditioned space. More or less curvature of the blades 3 and 4 affects the amount of air flow.

The air mixing device 1 is used in conjunction with the propeller or other type fan 5. This separate fan 5 puts the high velocity air to work by efficiently converting the low direct quantity of primary supply air at high velocity to a very high quantity of air movement at low velocity. The principle of operation is basically that of high velocity air forming a low pressure area where air is induced or aspirated into the higher velocity air stream. The overall energy remains constant as the primary air and aspirated air mix together. The total air flow put into motion is increased while the velocity is decreased.

Alternative structures to the preferred embodiment which is described herein include fans located other than at the lowermost extremity of the hollow leg section. For example, separate fans may be located proximate to the circumferentially extending outlet section to urge flow through the hollow leg section.

The contours of the air mixing device 1 define what may be considered as a generally vertically extending leg which communicates with a circumferentially extending outlet section. The intersection of the circumferentially extending outlet section and the deflector or splitter member 2 for dividing the flow around the circumferentially extending outlet section may be a ridge shaped splitter 2 having a cross-section which is substantially V-shaped or alternatively the apparatus may be substantially rotationally symmetrical with a cone shaped splitter 2. For example, the view of FIG. 1 would represent a section taken through a possible vertical plane of such a rotationally symmetrical plane.

Other applications for the apparatus in accordance with the invention, in addition to the use for mixing air in a room to minimize temperature differentials, include the mixing of gases in industrial processes.

A further application of this invention is the method which includes altering the interior environment of a room where insects pose a human nuisance. Many insects locate their human hosts by following the convective heat currents, vapor pressure, and natural body particles, odors and gases. The average human emits approximately one billion particles, less than 0.5 microns in size, every minute.

The method in accordance with the invention thoroughly mixes these convective heat currents, vapor pressure differences, natural body particles, odors and gases to such a high degree that the insects become confused and are unable to locate human beings in the ambient.

The invention has been described with reference to its illustrated preferred embodiment. Persons skilled in the art of constructing air inducing devices may, upon exposure to the teachings herein, conceive variations in the mechanical development of the components therein. Such variations are deemed to be encompassed by the disclosure, the invention being delimited only by the appended claims.

Having thus described my invention, I claim:

1. Apparatus for mixing air within a room, which comprises:

a hollow leg section having, at one axial location, a circumferentially extending outlet section, said leg section being disposed in substantially perpendicular relationship to said circumferentially extending outlet section;

a sleeve shaped first member disposed (1) in spaced relationship to said hollow leg section and (2) in spaced relationship from said circumferentially extending outlet section; and a fan disposed in axial spaced relation from the lowest extremity of said leg section with an opening to ambient therebetween and oriented to push ambient air into said leg section and out said circumferentially extending outlet section; and said fan being dimensioned to urge primary air through said fan, said sleeve shaped first member including means to cause the primary air to draw secondary ambient air from the room intermediate said sleeve shaped first member and said circumferentially extending outlet section into the room.

2. The apparatus as described in claim 1, wherein: said sleeve shaped first member is coaxial with said hollow leg section.

3. The apparatus as described in claim 2, wherein: said sleeve shaped first member is coaxial with said circumferentially extending outlet section.

4. The apparatus as described in claim 3, further including:

a splitter member disposed in said hollow leg section substantially at said circumferentially extending outlet section.

5. The apparatus as described in claim 4, wherein: said apparatus is rotationally symmetrical.

* * * * *